US007498536B2

(12) United States Patent
Chuang

(10) Patent No.: US 7,498,536 B2
(45) Date of Patent: Mar. 3, 2009

(54) KEY STRUCTURE OF A COMPUTER KEYBOARD

(75) Inventor: Cheng-Hua Chuang, Lujhou (TW)

(73) Assignee: Behavior Tech Computer Corp., Sijhih, Taipei County (TW)

( * ) Notice: Subject to any disclaimer, the term of this patent is extended or adjusted under 35 U.S.C. 154(b) by 0 days.

(21) Appl. No.: 11/945,438

(22) Filed: Nov. 27, 2007

(65) Prior Publication Data

US 2008/0121508 A1 May 29, 2008

(30) Foreign Application Priority Data

Nov. 27, 2006 (TW) ..... 95220869 U

(51) Int. Cl.
*H01H 13/70* (2006.01)

(52) U.S. Cl. ..... 200/344; 200/517

(58) Field of Classification Search ..... 200/5 A, 200/517, 341, 344, 345; 400/490–496
See application file for complete search history.

(56) References Cited

U.S. PATENT DOCUMENTS 5,829,579 A * 11/1998 Tsai ..... 200/344
5,973,281 A * 10/1999 Tsai ..... 200/344
6,064,020 A * 5/2000 Yamada et al. ..... 200/344
6,100,482 A * 8/2000 Koma et al. ..... 200/344
6,107,584 A * 8/2000 Yoneyama ..... 200/344
6,236,003 B1 * 5/2001 Suganami ..... 200/344
6,252,184 B1 * 6/2001 Tsai et al. ..... 200/344
6,328,489 B1 * 12/2001 Chi-Pin ..... 200/344
6,355,894 B2 * 3/2002 Miyakoshi ..... 200/344
6,376,789 B2 * 4/2002 Maruyama et al. ..... 200/344
6,504,120 B2 1/2003 Hsu
7,238,908 B1 * 7/2007 Chen ..... 200/344

FOREIGN PATENT DOCUMENTS

TW 427536 3/2001
TW 464934 11/2001

OTHER PUBLICATIONS

English language translation of abstract of TW 427536.

* cited by examiner

*Primary Examiner*—Michael A Friedhofer
(74) *Attorney, Agent, or Firm*—Thomas, Kayden, Horstemeyer & Risley

(57) ABSTRACT

A key structure, which comprises a key cap, a linkage mechanism, a fixed base, a resilient assembly and a membrane circuit board, of a computer keyboard is provided, The key cap has a top and a bottom. The fixed base, formed with a receiving space, has a top and a bottom. The linkage mechanism is disposed between the key cap and the fixed base. The resilient assembly fits into the receiving space of the fixed base and connected to the bottom of the key cap. The membrane circuit board is disposed on the bottom of the fixed base and located under the resilient assembly.

9 Claims, 3 Drawing Sheets

KEY STRUCTURE OF A COMPUTER KEYBOARD

This application claims the benefit from the priority of Taiwan Patent Application No. 095220869 filed on Nov. 27, 2006, the disclosures of which are incorporated by reference herein in their entirety.

CROSS-REFERENCES TO RELATED APPLICATIONS

Not applicable.

BACKGROUND OF THE INVENTION

1. Field of the Invention

The present invention relates to a key structure, which features a simplified manufacturing process, reduced costs, and improved waterproof performance, for use in a computer keyboard.

2. Descriptions of the Related Art

The key structure of a conventional computer keyboard comprises a metal board (e.g., an iron board) used as the supporting structure, with a fastening device for each of the key structures either formed directly onto the metal board or molded with a plastic-injecting mold. However, because different keyboards have different key arrangements, both methods require remolding for each different keyboard design, which is not only labor- and time-consuming, but also increases costs.

Taiwan patent No. 454934 published on Sep. 11, 2001 discloses a key switch device. According to the disclosure thereof, the fastening device, which comprises a supporting base and a guiding base, is directly formed onto the substrate (equivalent to the metal board described above). However, this device also needs to be remolded depending on the specific keyboard design. Moreover, a plurality of holes has to be formed in the circuit device disposed on the membrane circuit board for the supporting base and the guiding base to insert into the board. As a result, the manufacturing process is labor- and time-consuming and expensive. The key switch device also has a poor waterproof performance because water may penetrate into the membrane circuit board through the plurality of holes.

Taiwan patent No. 427536 published on Mar. 21, 2001 discloses a notebook computer keyboard. The notebook computer keyboard comprises a hard printed circuit board (PCB), a plurality of contact elements, a plurality of enclosing bases, a plurality of resilient assemblies, and a plurality of key switches. The hard PCB comprises an insulating substrate and a signal-transmitting layer for transmitting a plurality of key signals. The contact elements are disposed above the hard PCB, while the enclosing bases are also disposed above the hard PCB. Each enclosing base has a fastening device and a hole in the middle for accommodating an individual contact element. Each enclosing base is joined together with the hard PCB using the melting method. The resilient assemblies are respectively disposed above the contact elements, and are embedded and fastened into the enclosing bases, so that when the resilient assemblies are pressed, the key signals will be sent out. Each of the key switches includes a key cap and a supporting device. Each supporting device is attached to each fastening device of each enclosing base, while each key cap is disposed above the contact element and the resilient assembly. When a key switch is pressed, the key cap thereof would drive the resilient assembly to move downwards to close the corresponding contact element. Unfortunately, since this notebook computer keyboard uses a hard PCB as the substrate, the manufacturing process thereof is relatively complex due to the complicated multi-layer structure, of the hard PCB. As a result, manufacturing costs are increased.

In view of these shortcomings, many research efforts have been combined with the application of pertinent theories to provide an improved and inventive structure with a reasonable design.

SUMMARY OF THE INVENTION

The primary objective of this invention is to provide a key structure for use in a computer keyboard that has a simplified manufacturing process, reduced costs and improved waterproof performance.

This invention provides the key structure of a computer keyboard, which comprises a key cap, a fixed base, a linkage mechanism, a resilient assembly and a membrane circuit board. The key cap has a top and a bottom. The fixed base has a top and a bottom, and is formed with a receiving space on the top. The linkage mechanism is disposed between the key cap and the fixed base. The resilient assembly fits into the receiving space and is connected to the bottom of the key cap. The membrane circuit board is disposed on the bottom of the fixed base and located under the resilient assembly.

According to this invention, the linkage mechanism of each key structure is used in combination with a corresponding fixed base, while the assembled fixed base is adhered to the membrane circuit board. When a different keyboard design needs to be manufactured, remolding and placing holes in the membrane circuit board are not needed. By using the key structure of this invention, the manufacturing process is simplified, the cost is effectively reduced, and the waterproof performance is improved. Furthermore, since the key structure of this invention still uses a membrane circuit board, it is not necessary to redesign and produce a hard PCB as in the prior art, thus further reducing the costs.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1:
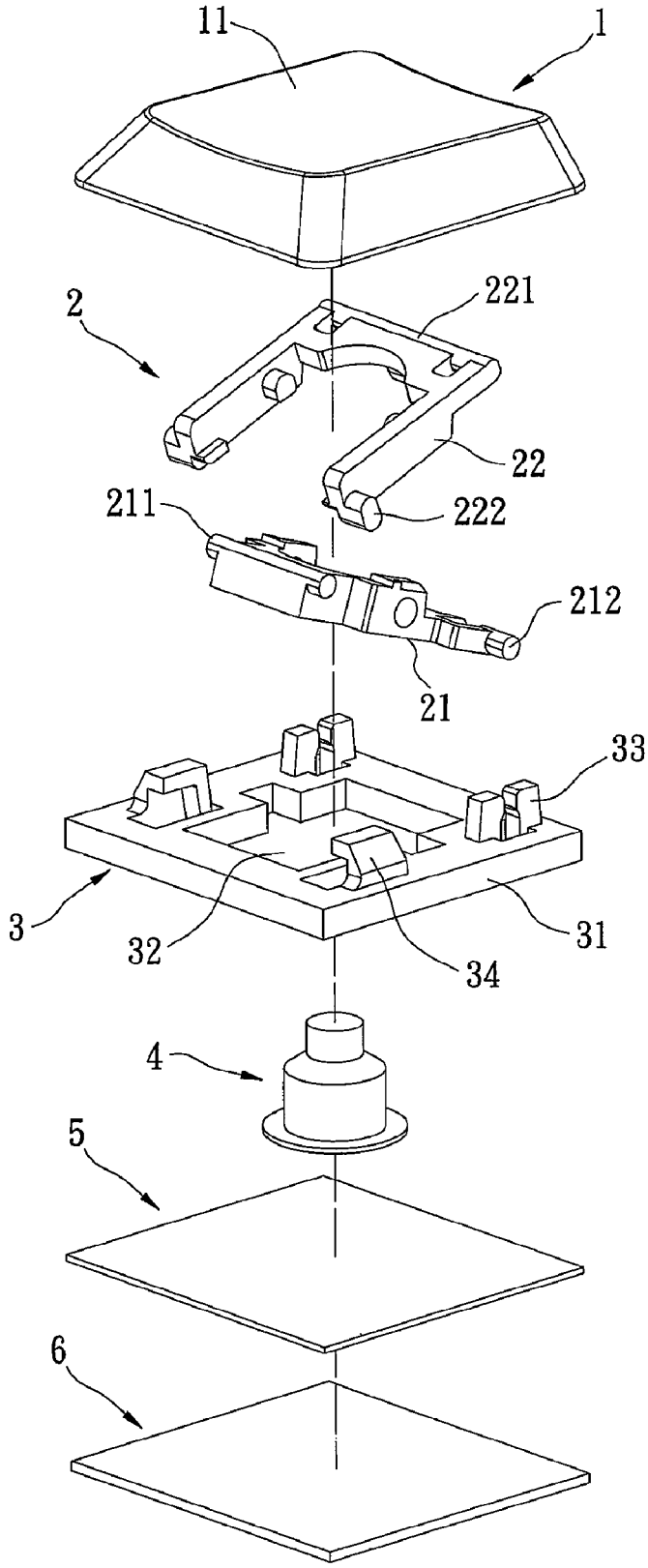
FIG. 1 is an exploded perspective view of a key structure in accordance with the embodiment of this invention.
Figure 2:
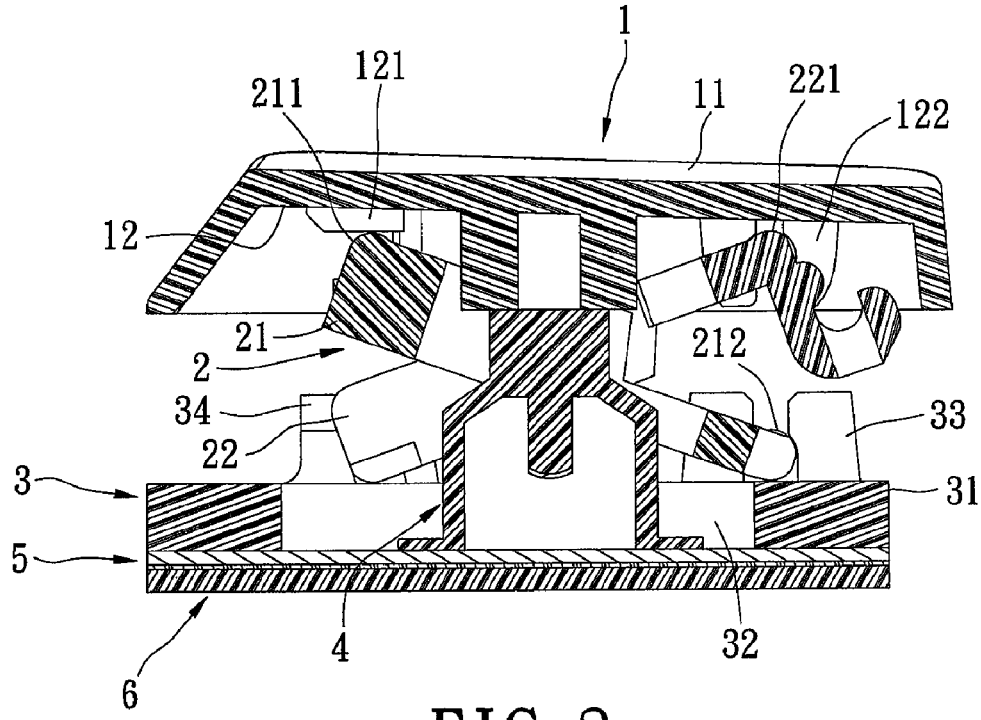
FIG. 2 is a cross-sectional view of a key structure in accordance with the embodiment of this invention.
Figure 3:
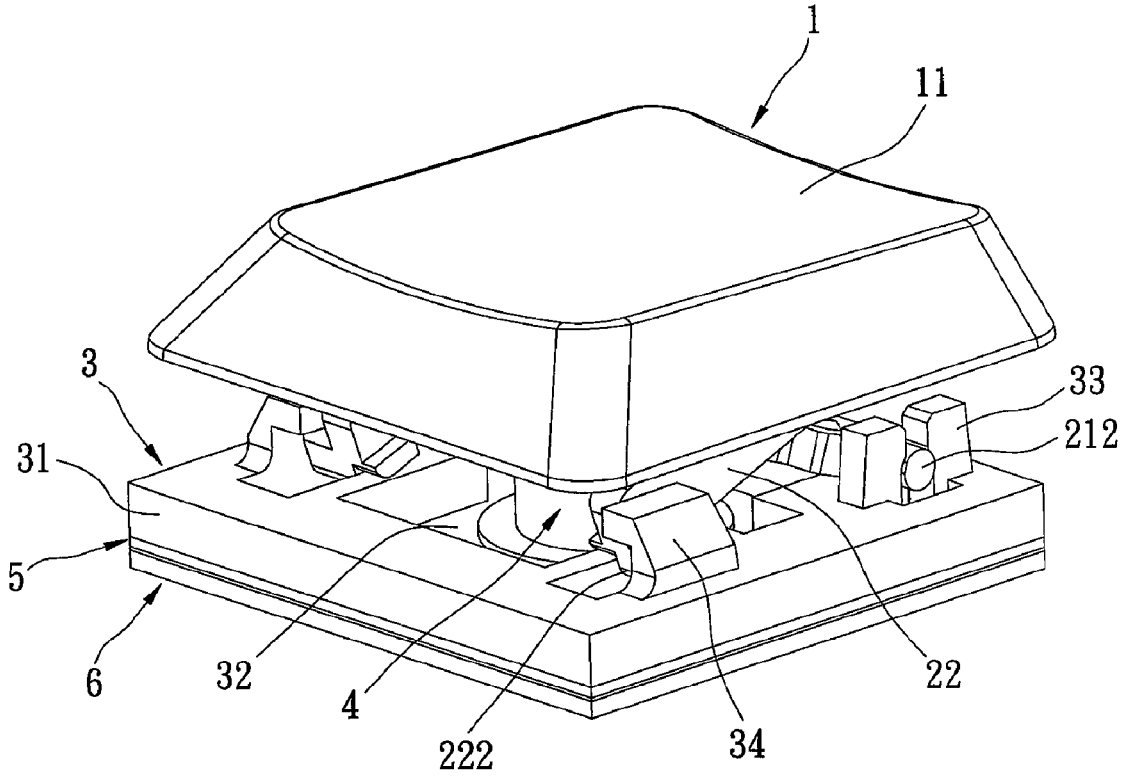
FIG. 3 is a perspective view of a key structure in accordance with the embodiment of this invention.
Figure 4:
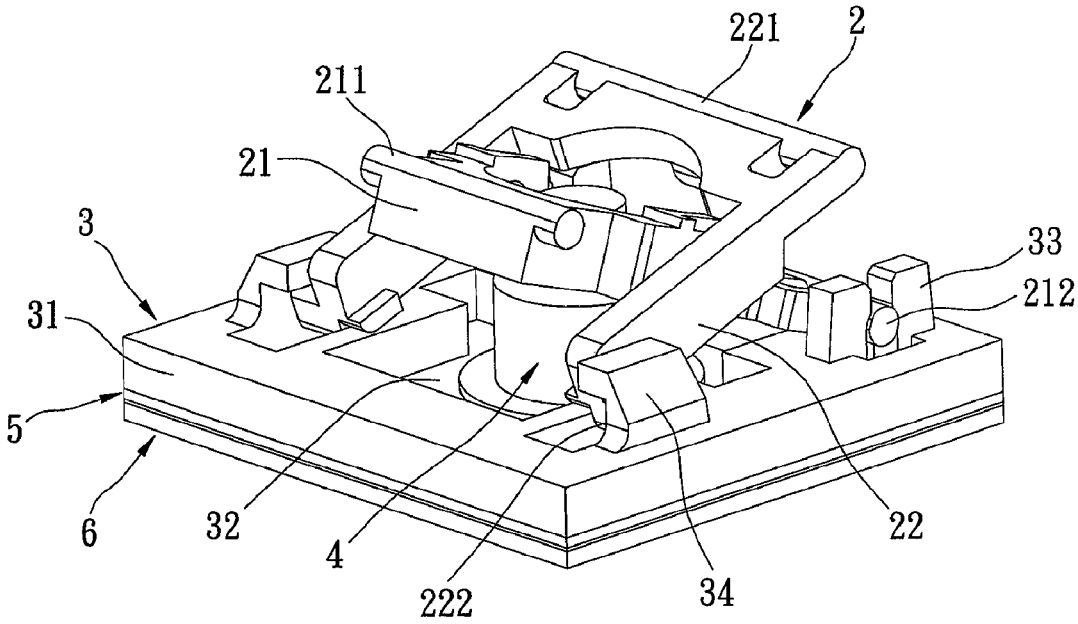
FIG. 4 is a perspective view of a key structure with the key cap uninstalled in accordance with the embodiment of this invention.
Figure 5:
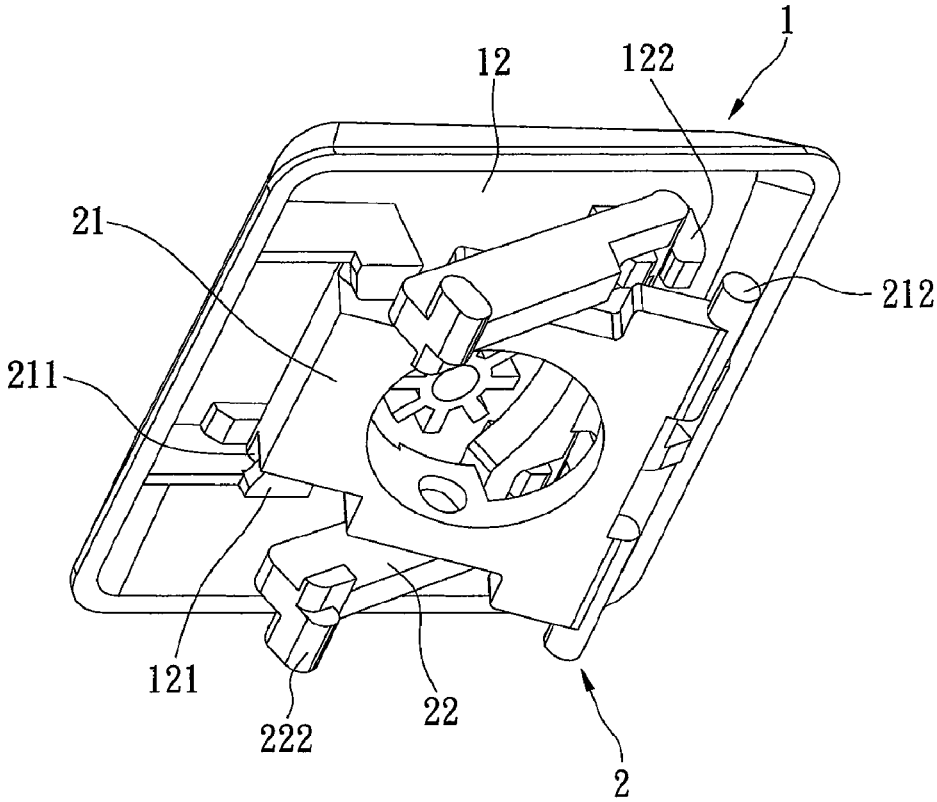
FIG. 5 is a perspective view of the key cap and the linkage mechanism in accordance with the embodiment of this invention.

FIGS. 1 to 5 illustrate a key structure of a computer keyboard in the embodiment of this invention. The key structure comprises a key cap 1, a linkage mechanism 2, a fixed base 3, a resilient assembly 4, a membrane circuit board 5 and a supporting board 6. In this embodiment, the key cap 1 is substantially shaped like a square cap, and has a top 11 and a bottom 12. Two first grooves 121 and two first snap-fit elements 122 protrude from the bottom 12 to connect with the top end of the linkage mechanism 2.

The linkage mechanism 2 comprises a first supporting frame 21 and a second supporting frame 22. The first supporting frame 21 and the second supporting frame 22 are disposed under the key cap 1, and pivot together to form a scissors-shaped structure. The first supporting structure 21 has a first sliding shaft 211 disposed on either side of the upper end thereof to slidably engage the two first grooves 121 of the key cap 1 respectively. The second supporting frame 22 has a first pivot shaft 221 disposed on either side of the upper end thereof to pivot and engage with the two first snap-fit elements 122 of the key cap 1 respectively. In this way, the first supporting frame 21 and the second supporting frame 22 can have their respective upper ends (the first sliding shaft 211 and the first pivot shaft 221) connected to the bottom 12 (the first groove 121 and the first snap-fit element 122) of the key cap 1 respectively.

The first supporting frame 21 has a second pivot shaft 212 disposed on either side of a lower end thereof respectively, and the second supporting frame 22 has a second sliding shaft 222 disposed on either side of a lower end thereof respectively. All of the second pivot shafts 212 and the second sliding shafts 222 are connected to the fixed base 3 respectively.

The fixed base 3 is disposed under the key cap 1 and the linkage mechanism 2. The fixed base 3 comprises a top 31 and a bottom, and is formed with a receiving space 32 penetrating therethrough. Protruding from the top 31 of the fixed base 3 are two second snap-fit elements 33 and two second grooves 34, which correspond to the two second pivot shafts 212 and the two second sliding shafts 222 of the lower end of the linkage mechanism 2 respectively. The two second pivot shafts 212 at the lower end of the first supporting frame 21 are engaged and pivoted together with the two second snap-fit elements 33 of the fixed base 3 respectively. Likewise, and the two second sliding shafts 222 at the lower end of the second supporting frame 22 are slidably engaged in the two second grooves 34 of the fixed base 3. In this way, the lower ends (the second pivot shafts 212 and the second sliding shafts 222) of the first supporting frame 21 and the second supporting frame 22 can be connected to the top 31 (the second snap-fit elements 33 and the second grooves 34) of the fixed base 3 respectively, so that the linkage mechanism 2 is linked between the key cap 1 and the fixed base 3.

The resilient assembly 4 is made of an elastomer such as rubber, and is disposed below the key cap 1. The resilient assembly 4 functions as a switch, i.e., once pressed downward to a certain extent, the circuit therebelow would be triggered to generate an electronic signal. The resilient assembly 4 is connected to the bottom 12 of the key cap 1, and fits into the receiving space 32 of the fixed base 3. In other words, the resilient assembly 4 is disposed between the key cap 1 and the membrane circuit board 5.

The membrane circuit board 5 is disposed on the bottom of the fixed base 3 and located under the resilient assembly 4, and is adhered upon the supporting board 6. In this embodiment, the supporting board 6 is a metal board (e.g., an iron board) used for supporting the membrane circuit board 5. The fixed base 3 and the membrane circuit board 5 are also adhered to each other. As a result, the key structure of this invention can be formed using the structure and method described above.

When the top 11 of the key cap 1 is pressed, the linkage mechanism 2 drives the resilient assembly downwards. The resilient assembly then becomes a switch that can trigger the corresponding circuit on the membrane circuit board 5 to generate an electronic signal.

According to this invention, each set of the linkage mechanisms 2 is used in combination with a fixed base 3, which is in turn adhered on the membrane circuit board 5. In case a different keyboard design with a different key arrangement is needed to be produced, only a rearrangement of the individual key structures is needed, instead of remolding. Additionally, the holes used to insert the snap-fit elements 33 and the grooves 34 of the fixed base 33 are eliminated from the membrane circuit board 5 of this invention, thus achieving a simplified manufacturing process, reduced cost, and improved waterproof performance.

Furthermore, since the key structure of this invention still uses an original membrane circuit board, it is not necessary to redesign and produce a hard PCB as in the prior art, thus further reducing the cost.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A key structure of a computer keyboard, comprising:

a key cap having a top and a bottom opposing to the top;

a fixed base, having a top and a bottom, and being formed with a receiving space;

a linkage mechanism, disposed between the key cap and the fixed base;

a resilient assembly, being received in the receiving space and connected with the bottom of the key cap; and a membrane circuit board, adhered onto the bottom of the fixed base and located under the resilient assembly.

2. The key structure as claimed in claim 1, wherein the linkage mechanism includes a first supporting frame and a second supporting frame pivoting with the first supporting frame to form a scissors-shaped structure, the first supporting frame and the second supporting frame each comprises an upper end and a lower end, in which the upper ends and the lower ends are connected to the bottom of the key cap and the top of the fixed based, respectively.

3. The key structure as claimed in claim 2, wherein the upper end of the first supporting frame has two sides, each has a first sliding shaft, the key cap has two first grooves protruded from the bottom of the key cap, and the first sliding shafts of the first supporting frame are slidably engaged in the first grooves of the key cap, respectively.

4. The key structure as claimed in claim 2, wherein the upper end of the second supporting frame has two sides, each has a first pivot shaft, the key cap has two first snap-fit elements protruded from the bottom of the key cap, and the first pivot shafts of the second supporting frame are engaged and pivoted with the first snap-fit elements of the key cap, respectively.

5. The key structure as claimed in claim 2, wherein the lower end of the first supporting frame has two sides, each has a second pivot shaft, the fixed base has two second snap-fit elements protruded from the top of the fixed base, and the second pivot shafts of the first supporting frame are engaged and pivoted with the second snap-fit elements of the fixed base, respectively.

6. The key structure as claimed in claim 2, wherein the lower end of the second supporting frame has two sides, each has a second sliding shaft, the fixed base has two second grooves protruded from the top of the fixed base, and the second sliding shafts of the second supporting frame are slidably engaged in the second grooves of the fixed base, respectively.

7. The key structure as claimed in claim 1, wherein the membrane circuit board is adhered upon a supporting board.

8. The key structure as claimed in claim 7, wherein the supporting board comprises a metal board.

9. The key structure as claimed in claim 1, wherein the resilient assembly is made of material comprising rubber.

* * * * *